US006935347B2

(12) United States Patent
Patel

(10) Patent No.: US 6,935,347 B2
(45) Date of Patent: Aug. 30, 2005

(54) SMOKING ARTIFACT

(76) Inventor: Ranchhodbhai D. Patel, 1817 Highway 41 N., Evansville, Vanderburgh County, IN (US) 47701

( * ) Notice: Subject to any disclaimer, the term of this patent is extended or adjusted under 35 U.S.C. 154(b) by 346 days.

(21) Appl. No.: 10/354,819

(22) Filed: Jan. 30, 2003

(65) Prior Publication Data

US 2003/0131858 A1 Jul. 17, 2003

Related U.S. Application Data

(63) Continuation-in-part of application No. 09/870,240, filed on May 30, 2001, now abandoned.

(51) Int. Cl.[7] ..... A24B 1/00
(52) U.S. Cl. ..... 131/360; 131/359; 131/364
(58) Field of Search ..... 131/347, 359, 131/360, 364

(56) References Cited

U.S. PATENT DOCUMENTS 5,992,421 A * 11/1999 Bae ..... 131/369

FOREIGN PATENT DOCUMENTS

CN 1088414 * 6/1994

* cited by examiner

*Primary Examiner*—Dionne A. Walls
(74) *Attorney, Agent, or Firm*—Gary K. Price, Esq.

(57) ABSTRACT

A smoking artifact having a tobacco rod section and a prior art filter section connected to the tobacco rod section. In the preferred embodiment, the tobacco rod section containing a plurality of aloeswood seeds. The aloeswood seeds may be applied either as whole seeds or as a powder from crushed seeds. In an alternate embodiment the tobacco rod section is compartmented into first and second partitioned areas. In this embodiment, the aloeswood seeds is disposed within the first partitioned area, and tobacco is disposed within the second partitioned area.

It is an object of the present invention to provide a non-poisonous alternate cigarette to reduce the hazards of smoking.

5 Claims, 2 Drawing Sheets

SMOKING ARTIFACT

CROSS REFERENCES TO RELATED APPLICATIONS

Continuation-in-part of U.S. Ser. No. 09/870,240, with filing date of May 30, 2001, entitled "Tobacco Additive" now abandoned.

STATEMENT AS TO RIGHTS TO INVENTIONS MADE UNDER FEDERALLY SPONSORED RESEARCH AND DEVELOPMENT

Not Applicable

BACKGROUND OF THE INVENTION

1. Field of the Invention

The present invention relates to a replacement for tobacco intended for use in smoking artifacts such as, but not restricted to, cigars, cigarettes, pipes and hookahs.

2. Background Information

A dictionary definition for a cigar, used for purposes of definition in this application is: "a more or less cylindrical roll of tobacco cured for smoking, of any various lengths, thicknesses, degrees of straightness, usually wrapped in a tobacco leaf".

A dictionary definition of a cigarette, used for purposes of definition in this application is: "a cylindrical roll of finely cut tobacco cured for smoking, considerably smaller than most cigars and usually wrapped in thin white paper".

A dictionary definition of a pipe, used for purposes of definition in this application is: "a tube of wood, clay, rubber, or other material, with a small bowl at one end, used for smoking tobacco".

A dictionary definition of hookah, used for purposes of definition in this application is: "a tobacco pipe with a long, flexible tube by which the smoke is drawn through a jar of water and thus cooled".

A dictionary lists aloeswood as agalloch. Agalloch is listed as the fragrant resonance wood of an East Indian thymelaeaceous tree, Aguilaria Agallocha, used as incense in the Orient. Also called agallachum, agalowood, agilawood, aloes, aloeswood, eagelwood, lignaloes, bishop's weeds or bishop's seeds.

As a natural grown herb, which is a tiny seed, can be grown abundantly in warm climate or mild climate. It has a medicinal value to its chemistry. It is helpful, when used to relieve discomfort of stomach and chest, by itself or mixed with turmeric powder, which is a herb root.

Health hazards of smoking tobacco are well documented. Generally, tobacco leafs are known to contain such harmful ingredients as nicotine and tar, and it is well known that smoking is a main cause of various diseases including lung cancer and coronary artery disorder.

Many smokers seem addicted and unable to quit smoking tobacco. As such, it is reported that the attack rate with lung cancer increases as the smoking population increases and non-smokers suffer from the smoke from smokers.

The present invention provides a non-poisonous alternate cigarette to reduce the hazards of smoking, by including alloeswood seeds as a tobacco substitute. CN 1088414 discloses an alcoholisated solution for tobacco, which solution includes agalloch eagleswood. This solution is sprayed according to a definite dosage onto the tobacco for catalytic fermentation. As such, CN 1088414 discloses applying the solution directly to the tobacco. This is not the case with the present invention. To the contrary, the present invention discloses compartmenting the alloeswood seeds from the tobacco. In addition, CN 1088414 discloses the addition of agalloch eagleswood to a solution comprising of sandalwood, aniseed, clove, honeysuckle, capsule of weeping forsythia, and isatis root. Such solution being sprayed according to a definite dosage on the tobacco. The present invention discloses use of the alloeswood seeds directly, rather than forming a solution as in CN 1088414, and the alloeswood seeds are not commingled with the tobacco, or in direct contact with the tobacco. Instead, the aloeswood seeds in the present invention either replace the tobacco, or is compartmented from the tobacco.

U.S. Pat. No. 5,992,421 to Bae, discloses a smoking composition wherein powdered seeds of plants/trees/herbs are utilized as part of the smoking material in cigarette. Again, '421 discloses the comingled in direct contact of the subject powdered herbs to the tobacco. It is noted that '421 does not disclose use of the alloeswood seeds as does the present invention. The present invention discloses either replacing the tobacco with the aloeswood seeds, or the compartmenting of the alloeswood seeds from the tobacco. '421 fails to make such disclosure, nor does '421 anticipate separating the powdered seeds of plants/trees/herbs from the tobacco section of the smoking artifact.

As will be seen in the subsequent disclosure, the preferred embodiment of the present invention overcome the deficiencies of existing art.

SUMMARY OF THE INVENTION

It is an object of the present invention to provide a non-poisonous alternate cigarette to reduce the hazards of smoking. The present invention is the use of aloeswood seeds as a tobacco substitute. As aloeswood seeds are tiny, they can be used either whole or as crushed into a powder.

The smoking artifact of the present invention includes a tobacco rod section and a prior art filter section connected to the tobacco rod section. The filter section being compartmented from the tobacco rod section. The tobacco rod section containing a plurality of aloeswood seeds. The aloeswood seeds may be applied either as whole seeds or as a powder from crushed seeds. An alternate embodiment is to partition the tobacco rod section so that the aloeswood seeds are disposed in a first partitioned area within the tobacco rod section and tobacco is disposed in a second partitioned area within the tobacco rod section. The first partitioned area being compartmented from the second partitioned area.

DESCRIPTION OF THE PREFERRED EMBODIMENT

Figure 1:
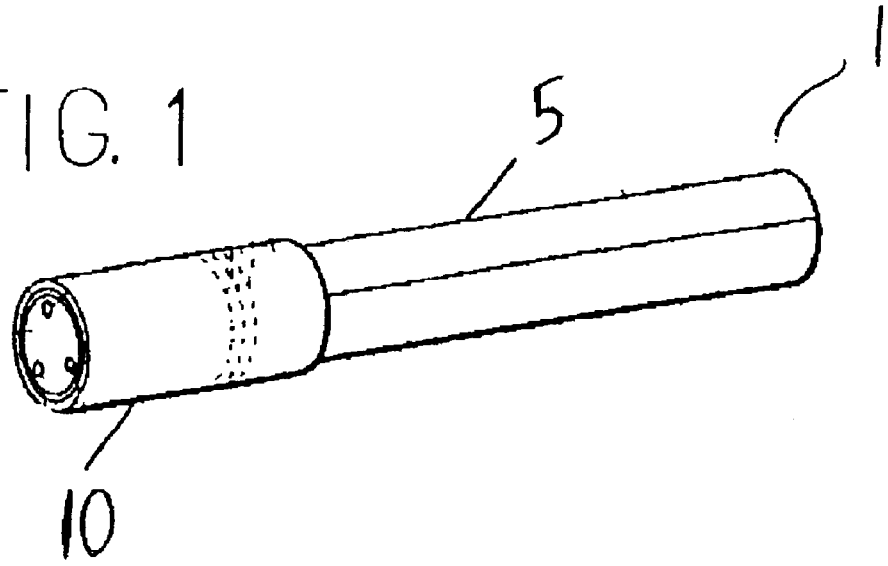
FIG. 1 is a perspective view of the preferred embodiment of the present invention, a smoking artifact.
Figure 2:
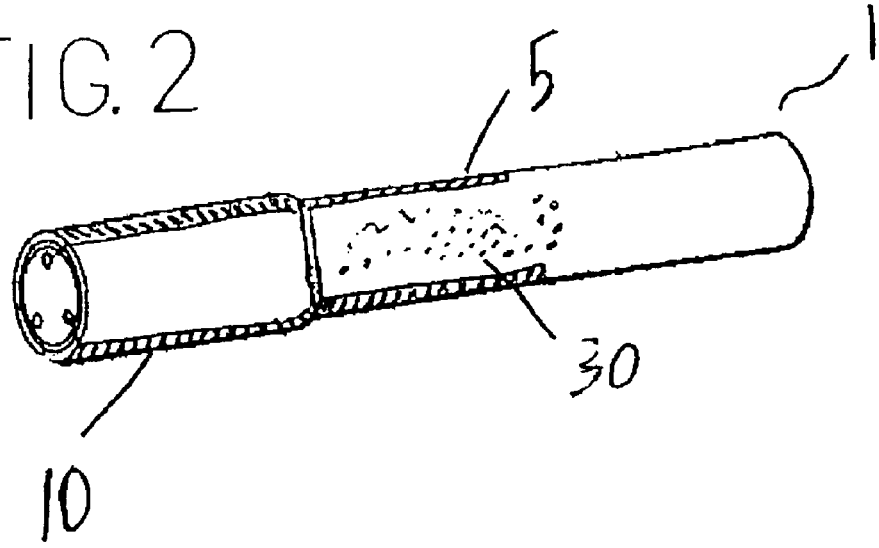
FIG. 2 is a sectional view of the smoking artifact of FIG. 1.

FIGS. 1–2 illustrate a preferred embodiment of a smoking artifact 1 made in accordance with the present invention. As shown in FIG. 1, the smoking artifact 1 includes a tobacco rod section 5 and a filter section 10 connected to the tobacco rod section 5. The preferred embodiment of the present invention is an introduction of a plurality of aloeswood seeds 30 for use in smoking the smoking artifact 1 such as, but not restricted to for use in cigars, cigarettes, pipes and hookahs, for the purpose of alleviating and relieving adverse effects from smoking tobacco. The aloeswood seeds 30 may be applied either as whole seeds or as a powder from crushed seeds.

In the preferred embodiment, and as shown in FIG. 2, the plurality of aloeswood seeds 30 is disposed in the tobacco rod section 5. The filter section 10 is known in the art. In this embodiment, the aloeswood seeds 30 serve as a medicinal filter. The smoke stream which passes from the tobacco rod section 5 through the filter section 10 is therefore diluted by the inclusion of the aloeswood seeds 30. As a result of the elimination of the prior art tobacco in the tobacco rod section 5, the dangers associated with smoking tobacco would be reduced, if not eliminated.

Figure 3:
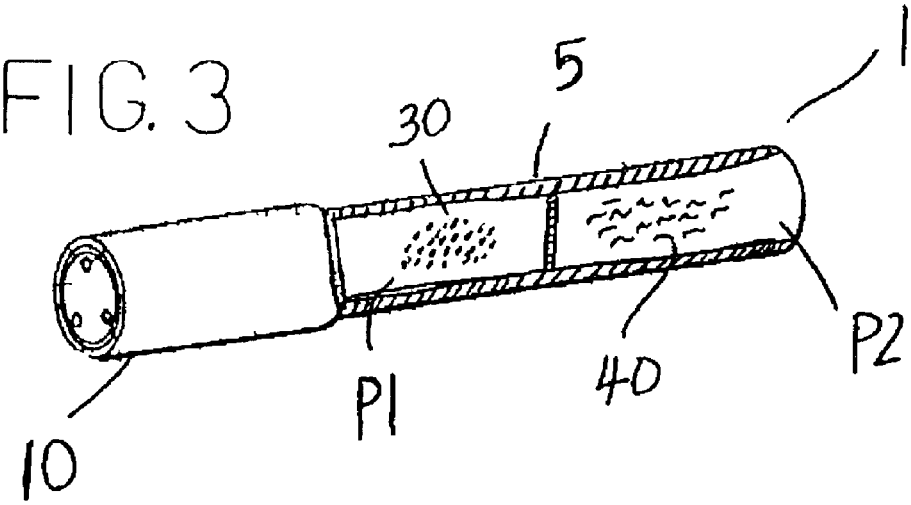
FIG. 3 is a sectional view of an alternate embodiment of the present invention.

An alternate embodiment of the present invention is to compartment the tobacco rod section 5 as shown in FIG. 3. In this embodiment, partitioned areas (designated P1 and P2) of the tobacco rod section 5 includes the aloeswood seeds 30 disposed in area P1, and tobacco 40 disposed in area P2 so that the tobacco 40 is compartmented from the aloeswood seeds 30. In this embodiment, a portion of the tobacco rod section 5 would include tobacco 40, and a compartmented section of the tobacco rod section 5 would include the aloeswood seeds 30 therein.

Obviously, this alternate embodiment as described is useful to help smokers stop smoking artifacts containing tobacco. In application, the ratio of tobacco 40 to aloeswood seeds 30 may be reduced in phases until the tobacco rod section 5 contains only aloeswood seeds 30 as discussed above. At such time, the tobacco 40, as well as the dangers associated with smoking tobacco would be eliminated.

Although the description above contains many specificities, these should not be construed as limiting the scope of the invention but is merely providing illustrations of some of the presently preferred embodiments of this invention.

It will be obvious skilled in the art that modifications may be made to the embodiments described above without departing from the scope of the present invention.

Thus the scope of the invention should be determined by the appended claims and their legal equivalents, rather than by the examples given.

I claim:

1. A smoking artifact comprising:

a tobacco rod section, a filter rod section connected to the tobacco rod section, and a plurality of aloeswood seeds disposed within the tobacco rod section.

2. The smoking artifact as recited in claim 1, wherein the tobacco rod section further comprises a first section and a second section, wherein the first section is compartmented from the second section.

3. The smoking artifact as recited in claim 2, wherein tobacco is disposed within the first section, and said aloeswood seeds is disposed within the second section.

4. A method for reducing the smoking of artifacts containing tobacco, which comprises:

(a) attaching a tobacco rod section to a filter rod section, wherein said tobacco rod section has a first section and a second section, said first section being compartmented from said second section, (b) inserting a selective volume of the tobacco within the first section, and inserting a selective volume of a plurality of aloeswood seeds within the second section.

5. The method of claim 4, wherein step (b) comprises:

reducing the volume of tobacco inserted within the tobacco rod section and increasing the volume of aloeswood seeds inserted within the tobacco rod section until the tobacco rod section contains only aloeswood seeds.

* * * * *